US011040394B2

(12) United States Patent
Just et al.

(10) Patent No.: US 11,040,394 B2
(45) Date of Patent: Jun. 22, 2021

(54) CASTING OF METALS

(71) Applicant: GF Casting Solutions AG, Schaffhausen (CH)

(72) Inventors: Michael Just, Neunkirch (CH); Holger Rammensee, Singen (DE)

(73) Assignee: GF CASTING SOLUTIONS AG, Schaffhausen (CH)

( * ) Notice: Subject to any disclaimer, the term of this patent is extended or adjusted under 35 U.S.C. 154(b) by 0 days.

(21) Appl. No.: 16/544,951

(22) Filed: Aug. 20, 2019

(65) Prior Publication Data

US 2020/0061698 A1 Feb. 27, 2020

(30) Foreign Application Priority Data

Aug. 21, 2018 (EP) ..... 18189842

(51) Int. Cl.
*B22D 17/00* (2006.01)
*B22D 17/20* (2006.01)
*B22D 17/08* (2006.01)

(52) U.S. Cl.
CPC ..... *B22D 17/08* (2013.01); *B22D 17/007* (2013.01); *B22D 17/20* (2013.01); *B22D 17/203* (2013.01)

(58) Field of Classification Search
CPC ..... B22D 17/007; B22D 17/02; B22D 17/04; B22D 17/08; B22D 17/20; B22D 17/30
USPC ..... 164/900
See application file for complete search history.

(56) References Cited

U.S. PATENT DOCUMENTS 4,842,038 A * 6/1989 Fujino ..... B22D 17/02 164/113
5,660,223 A * 8/1997 Thieman ..... B22D 19/0054 164/314
5,787,959 A * 8/1998 Laxmanan ..... B22D 17/007 164/66.1
2005/0067131 A1* 3/2005 DasGupta ..... B22D 17/007 164/113

FOREIGN PATENT DOCUMENTS

DE 10043717 A1 3/2002
EP 0936010 A1 8/1999
WO WO 0226426 A1 4/2002

* cited by examiner

*Primary Examiner* — Kevin E Yoon
(74) *Attorney, Agent, or Firm* — Leydig, Voit & Mayer, Ltd.

(57) ABSTRACT

A method for casting metals under pressure by a cold-chamber method includes placing a bolt of the metal to be cast in one of at least two casting chambers and selecting a casting chamber from the at least two casting chambers and feeding and introducing the selected casting chamber into a diecasting machine, the selected casting chamber having one outlet opening. The selecting and feeding of the casting chambers is carried out alternately from the at least two casting chambers. The method further includes heating the bolt by means of induction. Melting of the bolt in the selected casting chamber is carried out after the feeding and introducing of the selected casting chamber into the diecasting machine but before an opening of the outlet opening of the selected casting chamber in order to fill the cavities is completed.

8 Claims, 3 Drawing Sheets

CASTING OF METALS

CROSS REFERENCE TO RELATED APPLICATIONS

This application claims benefit to European Patent Application No. 18 189 842.0, filed Aug. 21, 2018, which is incorporated by reference herein.

FIELD

The invention relates to a method and to a device for casting metals, preferably light metals, under pressure by the cold-chamber method, containing a diecasting machine, a feed and a changer, wherein a bolt of the metal to be cast is placed in a casting chamber and fed to the diecasting machine and introduced.

BACKGROUND

Methods and devices for casting metals under pressure are known from the prior art, and are preferably used for light metals.

In the cold-chamber method, the diecasting machine and the furnace are arranged separately from one another, and the required melt, which is melted in the furnace, is fed manually or automatically to the casting chamber in the diecasting machine.

Such methods require a high energy outlay since relatively large quantities are usually melted in the furnace because the furnaces are configured for large quantities, and smaller charges need to be correspondingly increased to a quantity which a furnace requires. These quantities of melt must then correspondingly be kept hot if the entire quantity is not immediately required for the casting. This requires additional energy in order to keep the melt hot, as well as extra logistical and staffing outlay. All this entails a high energy outlay and correspondingly extra costs. Furthermore, it has a negative effect on the alloy diversity.

DE 100 43 717 A1 discloses a method and a device in which a provision space, or a press, preheats the material, which is provided as a bolt and is subsequently transferred through a channel into the casting chamber.

EP 0 936 010 A1 discloses a method in which the melt is transferred into a casting chamber which is heated by induction no undesired temperature gradient therefore occurs. Here again, however, the melt needs to be melted before in a furnace.

SUMMARY

In an embodiment, the present invention provides a method for casting metals under pressure by a cold-chamber method. The method includes placing a bolt of the metal to be cast in one of at least two casting chambers and selecting a casting chamber from the at least two casting chambers and feeding and introducing the selected casting chamber into a diecasting machine, the selected casting chamber having one outlet opening. The selecting and feeding of the casting chambers is carried out alternately from the at least two casting chambers. The method further includes heating the bolt by means of induction. Melting of the bolt in the selected casting chamber is carried out after the feeding and introducing of the selected casting chamber into the diecasting machine but before an opening of the outlet opening of the selected casting chamber in order to fill the cavities is completed.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
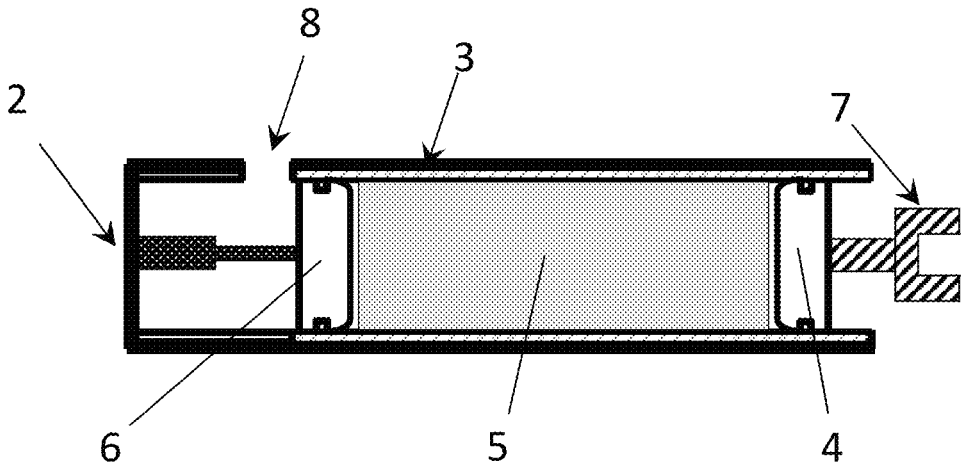
FIG. 1 shows a longitudinal section through a casting chamber for carrying out the method according to the invention.

In casting chambers in which the liquid melt is introduced directly, there is the disadvantage that the casting chamber can only partially be filled because of the entry opening and the liquid state of the metal to be cast, both in a horizontal and vertical arrangement, so that inter alia air inclusions may well occur in the alloy during the pressing of the melt into the cavities by means of the casting piston, which has a negative influence on the quality of the cast part.

Embodiments of the invention provide a device and an associated method which reduce the energy consumption and make it possible to cast smaller charges of alloys, and therefore also to allow a higher alloy diversity and to improve the component quality.

According to the invention, a method for casting metals, preferably light metals, under pressure by the cold-chamber method, comprises the following steps:

- placing a bolt of the metal to be cast in one of the at least two casting chambers,
- feeding and introducing a casting chamber into a diecasting machine, the casting chamber having respectively one outlet opening, the feed and the changing of the casting chambers being carried out alternately from at least two existing casting chambers, and
- heating the bolt by means of induction,
- wherein the melting of the bolt in the casting chamber is carried out after the feed and introduction of the casting chamber into the diecasting machine but before the opening of the outlet opening of the casting chamber in order to fill the cavities is completed.

Because the metal to be cast is placed as a bolt in one of the at least two casting chambers and is then melted, small charges of metal alloys for relatively low batch numbers of cast parts may also be cast. This allows more accurate tuning of the quantity of melt which is required, since it is not necessary to fill a furnace in order to obtain a corresponding quantity of melt in order to operate the furnace, and it avoids remelting of the metal for further charges. This in turn leads to an energy saving, and multiple melting of residual material produced is obviated. Because the quantity of the alloy can be tuned well to the batch number of cast parts required, a higher alloy diversity can also be cast. The casting chamber is fed with the bolt of the metal to be cast placed therein, preferably a light metal, to the diecasting machine. A changer is used for introducing the casting chamber into the diecasting machine, the removal of the casting chamber also being carried out by this. The feed and the changing of the casting chambers into and out of the diecasting machine is carried out on the basis of at least two casting chambers provided in the device, the changing process being carried out alternately. Of course, the device may also comprise more than just two casting chambers, which are fed to the diecasting machine and removed alternately. This allows a rapid diecasting process since the casting chambers heat the metal to just below the liquidus temperature before the feed to the diecasting machine, and the melting of the bolt into the liquid state is carried out in the diecasting machine. By heating the metal in the casting chamber by means of induction, precise and rapid heating is possible. This means that the bolt of the metal, preferably light metal to be cast, is fully melted in the casting chamber only after the feed and introduction of the casting chamber into the diecasting machine, but before the opening of the outlet opening for casting the liquid metal, or for filling the cavities. Before the introduction of the casting chamber into the diecasting machine is carried out, the metal to be cast is heated to just below the liquidus temperature, i.e. it is heated thus far before it is converted into the liquid state. This allows rapid liquefaction when the casting chamber is brought into the diecasting machine, and thus a rapid casting process.

Preferably, the final melting of the bolt is carried out inductively. This ensures precise and rapid melting into the liquid state. It is advantageous for the heating of the metal to be cast to close to the liquidus temperature, i.e. before the introduction of the casting chamber into the diecasting machine, likewise to be carried out inductively. The heating of the bolt in the casting chamber before the introduction to the diecasting machine as well as after the introduction of the casting chamber into the diecasting machine is preferably carried out by means of the same induction element, which is arranged in the casting chamber.

It has been found to be a preferred variant for the heating of the bolt up until the feed and introduction into the diecasting machine to be carried out to just below the liquidus temperature of the bolt, i.e. not yet liquefied.

It is one preferred embodiment of the method according to the invention that the casting chamber is entirely closed after the placement of the bolt, this preferably being closed with the casting piston. This allows almost 100% filling of the casting chamber with the metal to be cast, so that air inclusions are reduced and the quality of the cast pieces is substantially improved. The opening for placement of the bolt of the metal to be cast is preferably closed by means of the casting piston by its being brought up to the bolt and closing the casting chamber.

Preferably, in an embodiment, the invention is also distinguished in that a closure system releases the outlet opening in the casting chamber before the casting of the metal to be cast into the cavities to be filled. Preferably, at the opposite end of the casting chamber to the casting piston, there is a closure system which releases the outlet opening when the metal to be cast has the desired temperature and is liquid, preferably by the closure system being moved backwards, or in the same direction as the casting piston moves when compressing the melt, so that filling of the cavities with the molten metal is possible.

According to the invention, a device for casting metals, preferably light metals, under pressure by the cold-chamber method, comprises at least two casting chambers, the casting chambers being fed to the diecasting machine by means of the feed, and the casting chambers being changed, preferably alternately, by means of the changer between the feed and the diecasting machine. The device comprises at least two casting chambers which are fed alternately to the diecasting machine, a bolt, which consists of the metal to be cast, preferably light metal, respectively being placed in the casting chambers. In this way, proportional casting of the desired metal is possible. Of course, the device may also comprise more than two casting chambers which are alternately fed and introduced into the diecasting machine, and removed.

For example, a feed may take place horizontally to the diecasting machine or alternatively vertically by means of a transport system, and a revolver-like arrangement or other feed systems may also be envisaged.

It is a preferred embodiment that the casting chambers comprise an induction heating element. Each casting chamber comprises its own induction heating element which allows rapid and precise heating of the bolt of the metal to be cast. The induction heating element is preferably arranged along the circumference of the casting chamber and ensures homogeneous heating of the bolt.

Preferably, the casting chambers respectively comprise a closure system which closes the outlet opening in the casting chamber and releases it shortly before the filling of the cavities. The closure system is preferably arranged at the other end of the casting chamber opposite the casting piston. As soon as the metal has the desired temperature, i.e. it is liquid, the closure system releases the outlet opening for casting the liquid metal into the cavities. Preferably, to this end a piston is provided which moves backwards and thereby releases the opening for the liquid metal.

According to a preferred embodiment, the device comprises a piston coupling system, and the casting chambers respectively comprise a casting piston, the casting piston being connected by the piston coupling system to the diecasting machine when changing the casting chamber by means of the changer from the feed into the diecasting machine. The effect achieved by this is that the casting piston is connected to a drive system in the diecasting machine in order to press the molten metal in the casting piston into the cavities. Since the casting piston and the closure system are respectively provided per casting chamber, there is also the advantage that the casting chambers can be fully closed and therefore also filled to almost 100%.

It has been found advantageous for the casting chambers to be arranged in a closed circuit with respect to one another and to be fed alternately to the diecasting machine. This circuit may correspond to a vertically as well as horizontally running feed, for example a conveyor belt or alternatively a revolver in which the casting chambers are arranged concentrically around a rotation point, and other feeds may also be envisaged.

All configuration possibilities may be combined freely with one another, and the method and device features may be combined individually with one another.

Figure 2:
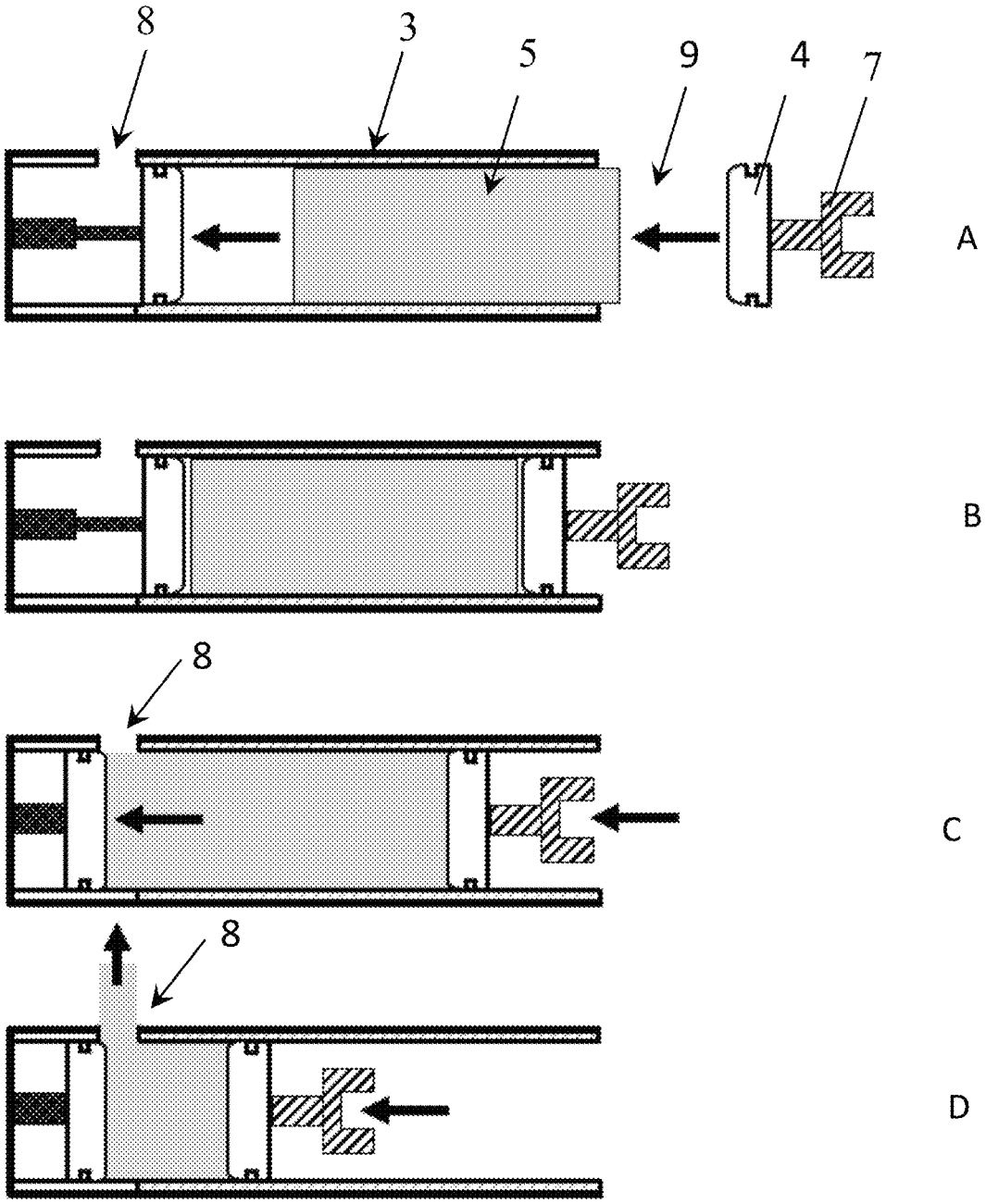
FIG. 2 shows a stepwise representation of the method in a casting chamber.

The drawing represented in FIG. 1 shows a casting chamber 2 of a device 1 according to the invention, the bolt 5 of metal to be cast already been placed and the casting chamber 2 being fully closed. Arranged along the circumference of the casting chamber 2 is the induction heating element 3, which preferably extends over the length of the casting chamber 2 in order to ensure homogeneous heating of the bolt 5. It can be seen clearly that almost 100% filling of the casting chamber 2 can be achieved by the introduction of the metal to be cast as a solid, which is conducive to reducing air inclusions in the cast part. In the casting chamber 2 of the device 1 according to the invention, the bolt is placed through the entry opening 9 into the casting chamber 2, as can be seen in FIG. 2. Subsequently, the casting piston 4 is moved up to the bolt 5 and the closure system 6 keeps the outlet opening 8 closed, so that the casting chamber is completely closed. A closure piston is preferably used as the closure system 6, although other possibilities may also be envisaged. The piston coupling system 7 arranged on the casting piston 4 is used to connect the casting piston 4 to the diecasting machine 10, or to a drive provided therefor, in order to press the molten metal through the outlet opening 8 into the cavities.

FIG. 2 shows a stepwise representation of the method in a casting chamber 2 of the device 1, in position A the bolt 5 of the metal to be cast being placed in the casting chamber 2 and the casting piston 4 being brought up to the bolt 5 in order to close the casting chamber 2. In position B, it can be seen that the casting chamber 2 is fully closed and almost 100% filling is achieved. In this state, the casting chamber 2, or the bolt 5, is heated by means of the induction heating element 3, heating being carried out to just below the liquidus temperature before introduction into the diecasting machine 10, preferably during the feed 11 of the casting chamber 2 to the diecasting machine 10, see FIGS. 3 and 4. By the changer (not represented), the casting chamber 2 is introduced into the diecasting machine 10, or the casting chamber 2 previously arranged in the diecasting machine 10 is removed. Position C shows the position in which the casting chamber 2 is already arranged in the diecasting machine 10 and the metal is liquid, and has the desired temperature for the casting. The closure system 6 releases the outlet opening 8 and the casting piston 4, which is connected by means of the piston coupling system 7 to a drive, presses the liquid metal through the outlet opening 8 into the cavities, which can be seen from image D.

Figure 3:
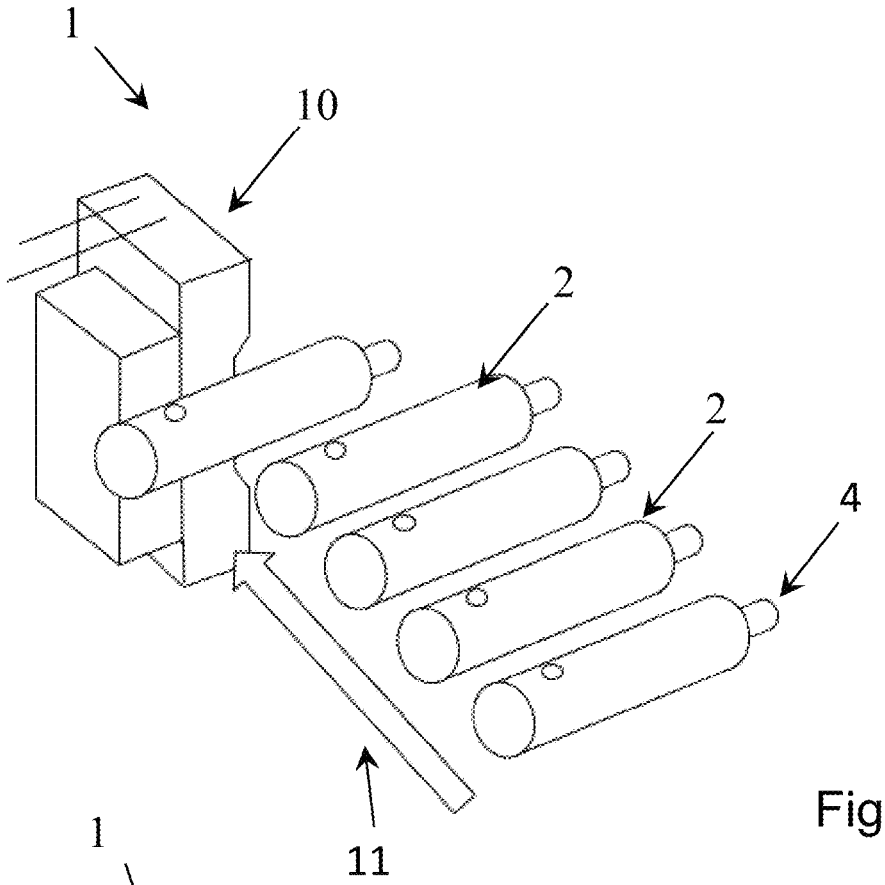
FIG. 3 shows a device according to the invention with a linear feed.
Figure 4:
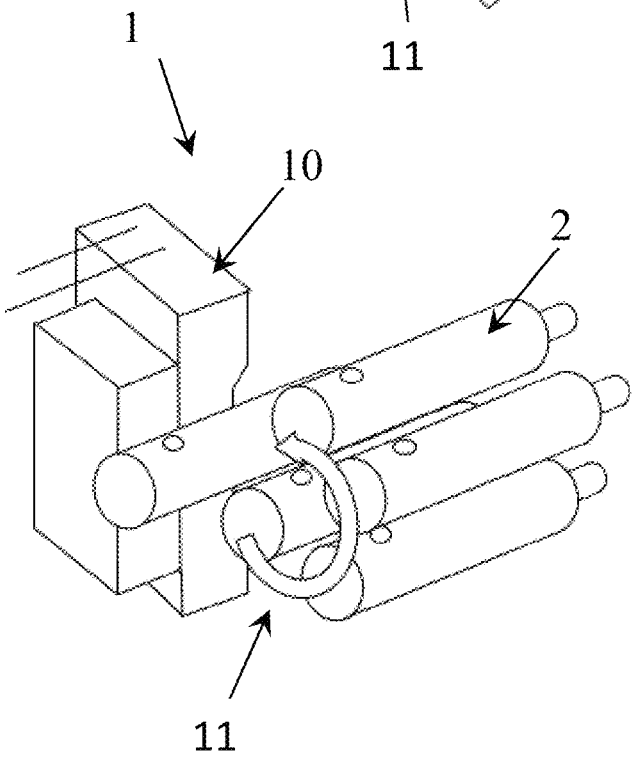
FIG. 4 shows a device according to the invention with a revolver-like feed.

FIGS. 3 and 4 show possible feeds 11 of casting chambers 2 to the diecasting machine 10. FIG. 3 shows a horizontal feed 11, although a vertical feed of casting chambers 2 may also be envisaged. The number of casting chambers 2 is to be matched to the device 1, or speed and capacity, at least two casting chambers 2 having to be arranged in a device 1 according to the invention in order to carry out preheating to just below the liquidus temperature and subsequent heating in the diecasting machine 10 until the metal is liquid, or in order to ensure an optimal and economical process. FIG. 4 shows an alternative arrangement of the casting chambers 2, which are arranged concentrically around a centre and constitute a kind of revolver. The transfer of the casting chambers 2 from the feed 11 to the diecasting machine 10 is carried out by means of a changer (not shown).

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 device
2 casting chamber
3 induction heating element
4 casting piston
5 bolt of material to be cast
6 closure system
7 piston coupling system
8 outlet opening
9 entry opening
10 diecasting machine
11 feed

What is claimed is:

1. A method for casting metals under pressure by a cold-chamber method, the method comprising:

placing a bolt of a metal to be cast in a first casting chamber, the first casting chamber having an outlet opening;

heating to an intermediate temperature, in the first casting chamber and by way of induction, the bolt of the metal to be cast; and selecting the first casting chamber from a set of at least two casting chambers and feeding and introducing the first casting chamber with the heated bolt of the metal to be cast into a diecasting machine, wherein the selecting and feeding of the casting chambers is carried out alternately from the casting chambers of the set of at least two casting chambers;

melting, in the first casting chamber, of the heated bolt, the melting being performed after the feeding and introducing of first casting chamber into the diecasting machine; and opening the outlet opening of the first casting chamber and filling cavities of the diecasting machine with the melted metal to be cast.

2. The method according to claim 1, wherein melting of the heated bolt is carried out inductively.

3. The method according to claim 1, wherein the intermediate temperature is a temperature below the melting temperature of the bolt.

4. The method according to claim 1, wherein the first casting chamber is entirely closed after the placing of the bolt therein.

5. The method according to claim 4, wherein the first casting chamber is entirely closed with a casting piston after the placement of the bolt.

6. The method according to claim 1, wherein the opening the outlet opening of the first casting chamber comprises releasing, by a closure system, the outlet opening.

7. The method according to claim 1, wherein the filling the cavities of the diecasting machine with the melted metal to be cast is performed by pressing, by a casting piston, the melted metal to be cast through the outlet opening of the first casting chamber.

8. The method according to claim 7, wherein the placing the bolt of the metal to be cast in the first casting chamber is performed by inserting the bolt through an entry opening in the first casting chamber, and wherein the casting piston is inserted, after the placement of the bolt, into the entry opening of the first casting chamber so as to close the first casting chamber.

* * * * *